US006119423A

United States Patent [19]

Costantino

[11] Patent Number: 6,119,423

[45] Date of Patent: Sep. 19, 2000

[54] APPARATUS AND METHOD FOR INSTALLING HARDWOOD FLOORS

[76] Inventor: John Costantino, 5901 Town Bay Dr., Apt. 812, Boca Raton, Fla. 33486

[21] Appl. No.: 09/152,731

[22] Filed: Sep. 14, 1998

[51] Int. Cl.[7] ..... E04F 15/04; E04F 15/022

[52] U.S. Cl. ..... 52/390; 52/314; 52/313; 52/98; 52/391; 52/392; 52/747.1; 52/747.11

[58] Field of Search ..... 52/98, 99, 390, 52/391, 385, 384, 311.1, 313, 314, 555, 746.12, 747.1, 747.11, 748.1, 748.11, 392

[56] References Cited

U.S. PATENT DOCUMENTS

| | | | |
|---|---|---|---|
| 101,634 | 4/1870 | McAlister | 52/313 |
| 1,828,193 | 10/1931 | Levin | 52/314 X |
| 2,063,935 | 12/1936 | Kirschbraun | 52/314 |
| 2,122,577 | 7/1938 | Mattes et al. | 52/314 |
| 2,253,943 | 8/1941 | Rice | 52/391 X |
| 2,894,292 | 7/1959 | Gramelspacher | 52/747.11 X |
| 3,008,256 | 11/1961 | Rice | 52/98 |
| 3,279,138 | 10/1966 | Dittmar | 52/390 X |
| 3,908,326 | 9/1975 | Francis | 52/384 |
| 4,060,437 | 11/1977 | Strout . | |
| 4,409,269 | 10/1983 | Gardner . | |
| 4,415,616 | 11/1983 | Angioletti . | |
| 4,416,100 | 11/1983 | Troendle, Sr. | 52/390 |
| 4,432,177 | 2/1984 | Amesso et al. . | |
| 4,832,995 | 5/1989 | McLauchlin . | |
| 5,058,349 | 10/1991 | Conrad | 52/392 |
| 5,103,614 | 4/1992 | Kawaguchi et al. | 52/392 |
| 5,117,602 | 6/1992 | Marschak . | |
| 5,157,890 | 10/1992 | Jines . | |
| 5,283,102 | 2/1994 | Sweet et al. | 52/391 X |
| 5,438,809 | 8/1995 | Ehrlich . | |
| 5,661,937 | 9/1997 | Doppler et al. . | |
| 5,755,068 | 5/1998 | Ormiston | 52/314 |
| 6,021,615 | 2/2000 | Brown | 52/392 |

FOREIGN PATENT DOCUMENTS

| | | | |
|---|---|---|---|
| 23756 | 11/1929 | Australia | 52/384 |
| 149468 | 7/1951 | Australia | 52/391 |
| 3919514 | 12/1990 | Germany | 52/313 |
| 3-241168 | 10/1991 | Japan | 52/390 |

*Primary Examiner*—Laura Callo
*Attorney, Agent, or Firm*—John C. Smith

[57] ABSTRACT

An interlocking prefabricated hardwood floor panel system in which multiple hardwood strips are secured together and attached to a substrate. The hardwood strips end at different locations such that a straight seam is not formed between adjacent floor panels. The substrate covers at least a portion of the floor panel and may extend past the edge of the hardwood strips such that hardwood strips from an adjacent floor panel can be secured to the substrate. Alternative embodiments provide hardwood strips that vary in color to allow designs to be inserted into a floor by using different woods or different stains. The substrate is secured to a target surface which may be the surface of the floor, a ceiling, or wall. The substrate can be attached to the target surface via any appropriate method, such as adhesive, nails, screws, etc.. A variety of flooring patterns can be used including hardwood strips, parquet squares, herringbone, etc.

15 Claims, 11 Drawing Sheets

APPARATUS AND METHOD FOR INSTALLING HARDWOOD FLOORS

BACKGROUND OF THE INVENTION

1. Technical Field

The present invention relates to hardwood flooring. In particular, it relates to interlocking prefabricated hardwood flooring panels that have multiple hardwood strips secured to a substrate, and a method of installing the prefabricated hardwood floor panels with adjacent hardwood floor panels.

2. Background Art

A wide variety of flooring materials are available for use in residential and commercial applications. Hardwood floors are a popular method of providing a decorative and long-lasting floor surface. While hardwood floors have several advantages due to their durability and natural beauty, they also have several disadvantages. For example, the hardwood strips used to fabricate a hardwood floor are expensive due to the cost of the hardwood. In addition, hardwood floors require a skilled craftsman to install the floor. As a result, the combined cost of the materials and the labor are relatively high. The high cost of installing a hardwood floor has in turn discouraged many people from selecting this type of flooring.

Attempts have been made to provide the esthetic look of hardwood floors without the associated costs. One method has been to provide a surface covering that has a relatively thin veneer of hardwood which is attached to a substrate. This type flooring, while providing the appearance of a hardwood floor, has several disadvantages. First, the thin veneer is not as durable as a real hardwood floor surface is. It is more susceptible to damage from normal use than the thicker strips used in a real hardwood floor. It is more difficult to repair and cannot be sanded in the same manner as a real hardwood floor. As a result, while flooring made from hardwood veneers resembles hardwood flooring, it is more susceptible to damage, is difficult to repair, and sanding cannot be done without risking damage to the veneer. Due to these factors, veneers have a relatively short life span and will have to be replaced much sooner than a real hardwood floor. Hardwood flooring, on the other hand, will last for the life of the building, can be repeatedly sanded, and is less susceptible to damage. Therefore, it would be desirable to have a method of installing real hardwood flooring that would allow it to be installed inexpensively such tat more individuals could enjoy its benefits.

Another disadvantage of veneers is that due to its thin structure, it cannot be readily stained from one color to another. Real hardwood flooring allows the owner to stain the floor or sand the floor to change the floor's color or merely to remove blemishes.

Another major disadvantage to hardwood veneer flooring is that it is made in rectangular panels. When the rectangular panels are installed, the seams that are formed when the rectangular panels are installed adjacent to another are very visible and make it very obvious that floor has been covered with panels rather than with real hardwood. It would be desirable to have a hardwood flooring systems that can be installed without having straight seams that detract from the appearance of the floor.

Labor cost is another disadvantage associated with real hardwood flooring. While rectangular veneer panels can be easily installed by an unskilled worker, strips of real hardwood require skill to install. The skilled labor cost greatly increases the total cost of installing a real hardwood floor. It would be desirable to have method installing real hardwood floors that would allow unskilled workers to install the floor, or even allow the owner to install floor without using a laborer.

Another disadvantage of installing real hardwood floors is that the individual strips of hardwood will vary and the skill of the installer will also vary. These variances result in imperfections in the finished floor. For example, the seam between adjoining strips of hardwood may be larger than desirable and provide a place for dirt to collect. It would be desirable to have a real hardwood flooring system that minimized the size of the seam such that most desirable surface appearance would be produced.

In addition to a plain hardwood floor in which all of the hardwood strips are similar, many hardwood floors use floor strips of hardwood which vary in color or grain pattern to floor specific designs or floor treatments. For example, darker or lighter woods may be used to create a border around the edge of the floor or to create patterns or images at various locations on the floor. It would be desirable to have a flooring system that would allow designs or borders to be easily installed in a real hardwood floor.

While addressing the basic desirability of using hardwood floors, the prior art has failed to provide a method installing hardwood floors which is inexpensive to manufacture, requires a minimum level of skill to install, and minimizes imperfections in the finish flooring that are the result of installation errors. The prior art has also failed to provide an easy to use method of installing decorative features such as borders or designs in hardwood floors.

SUMMARY OF THE INVENTION

The present invention solves the foregoing problems by providing interlocking prefabricated hardwood floor panels in which multiple hardwood strips are secured together and attached to a substrate. The hardwood strips end at different locations such that a straight seam is not formed between adjacent floor panels. The substrate covers at least a portion of the floor panel and may extend past the edge of the hardwood strips such that hardwood strips from an adjacent floor panel can be secured to the substrate. Alternative embodiments provide hardwood strips that vary color such that designs may be inserted into a floor by using different woods or different stains. The substrate is secured to a target surface which may be the surface of the floor, a ceiling, or wall. The substrate can be attached to floors, ceilings, or walls. A variety of flooring patterns can be used including hardwood strips, parquet squares, herringbone, etc.

DESCRIPTION OF THE PREFERRED EMBODIMENT

Figure 1:
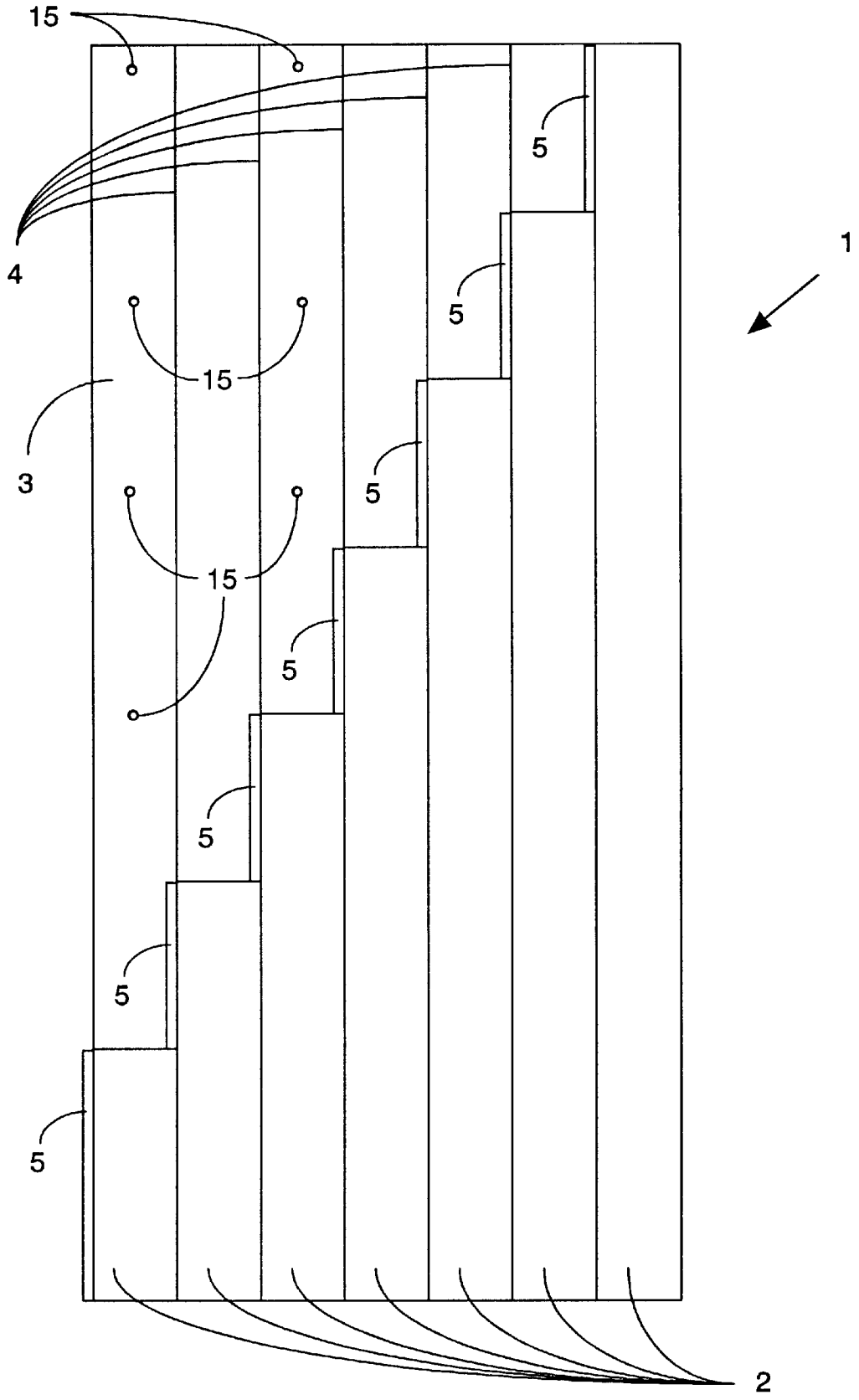
FIG. 1 is a top plan view of a preferred embodiment of a hardwood floor panel which shows the hardwood strips attached to a substrate.

Prior to a detailed discussion of the figures, a general overview of the invention will be provided. The invention provides a flooring installer, whether a professional or a novice, to quickly and easily install large areas of hardwood floors. Heretofore, hardwood floors required a skilled installer. As result, a hardwood floor was more expensive than it needed to be due to the high cost of labor. The invention provides the large substrate which is prefabricated at the factory and holds numerous hardwood strips that have been pre-assembled. This pre-fabrication saves the installer a substantial amount of time since the installer is no longer required to install hardwood strips one at a time.

In addition to saving on the cost of labor, prefabricated floor panels are precisely assembled at the factory. This results in a more precise alignment of the hardwood strips in relation to one another that in turn results in a more professional appealing floor. A benefit of saving both labor costs and having a more precisely aligned floor panel allows someone with limited skill, such as a homeowner to install hardwood floors on a do-it-yourself basis. Because of this, hardwood floors are now available to individuals that may not have been able to afford them before.

Be variety of methods can be used to secure the floor panels to the floor. In the preferred embodiment, adhesive is used to secure the substrate to the target surface. Optionally, nails, screws, etc. may also be used to secure floor panels to target surfaces. While it is expected that the principal use of the invention will be for flooring, it is also possible to use the flooring panels on walls or ceilings. Likewise, while the principal use of the invention is to install hardwood flooring, other materials such as synthetic flooring, marble, etc. may also be installed using this technique.

By varying the type or color of the hardwood, decorative patterns can be designed to further enhance the appearance of the flooring. Even intricate designs or commercial indicia, such as logos, can be installed with this method. The patterns can be prefabricated at the factory and shipped to the installer for easy installation.

The flooring system described herein can come in a variety of finishes. It can be pre-finished and stained at the factory, or shipped with the surface in an unfinished state to allow sanding and finish work to be performed during the installation procedure.

Another advantage of the instant invention is that eliminates the straight seams which are created by prior art veneer systems. In the prior art systems, low-cost rectangular veneer panels allowed the user to install a less expensive flooring that resembled a hardwood floor. These floors, however, are relatively flimsy comparison to a standard hardwood flooring strip. As a result, they wear out faster and require more maintenance in a real hardwood floor. The cosmetic appearance of the veneer systems also has drawbacks in that their rectangular shape results in a noticeable seam line which extends across several strips of wood. This not only detracts from the overall appearance of the floor, it also indicates to anyone familiar with flooring that it is not a real hardwood floor. The invention uses and irregular pattern of hardwood strips which end at different points. This eliminates the seam that runs across prior art veneer flooring systems. Since there is no seam, an observer would be unable to determine if the panel system of the instant invention was used or if individual strips of hardwood were installed in the prior art manner.

In addition to improving the appearance of the floor by avoiding straight seams, the varying lengths of the hardwood strips increases the strength of the floor by avoiding weak points which would be produced by straight seams.

While the invention has been discussed primarily in terms of its use as a technique for installing hardwood floors, the same techniques can be used for other surfaces, such as ceilings and walls.

Referring to FIG. 1, this figure shows a top plan view of a preferred embodiment of the invention. In this embodiment, a number of hardwood strips 2 are attached to a substrate 3. The hardwood strips 2 can be secured to the substrate 3 by any convenient means. For example, screws could be threaded through the bottom of the substrate 3 and into the hardwood strips 2. However, in the preferred embodiment, the hardwood strips 2 are secured to the substrate 3 with an adhesive. In this embodiment, the hardwood strips 2 have a tongue in groove configuration. Each hardwood strip 2 has a tongue 5 which fits into a groove 16 (shown in FIG. 2) on the edge of the adjacent hardwood strip 2. The tongue in groove configuration adds additional strength to the floor panel 1 since each hardwood strip 2 assists in securing the adjacent hardwood strips 2. Those skilled art will recognize that additional steps can be taken such as placing a bead of adhesive or glue along the length of the tongue 5 or along the length of groove 16.

An advantage of using hardwood floor panel 1 is that the hardwood strips 2 can be attached to the substrate 3 in factory conditions, rather than at the work site. This provides the manufacturer the ability to more precisely fit the adjacent hardwood strips 2 together which results in tighter seams between adjacent hardwood strips 2 and better overall quality control.

Also shown in this figure are optional score lines 4 which are positioned at the edge of each hardwood strip 2. The score lines 4 allow the person installing the floor panel 1 to break the floor panel 1 along a selected score line 4. By breaking the floor panel 1 along a score line 4, the installer can adjust the width of the floor panel 1 to fit a particular target area size.

Optional nail apertures 15 are shown in the substrate 3. While preferred embodiment uses adhesive to secure floor panel 1 to a target surface, those skilled in the art will recognize that the floor panel 1 can also be secured to a target surface with nails, screws, etc.. The location of the mail apertures 15 is not critical, and the nails can be driven through the floor panel 1 at any convenient location.

Figure 2:
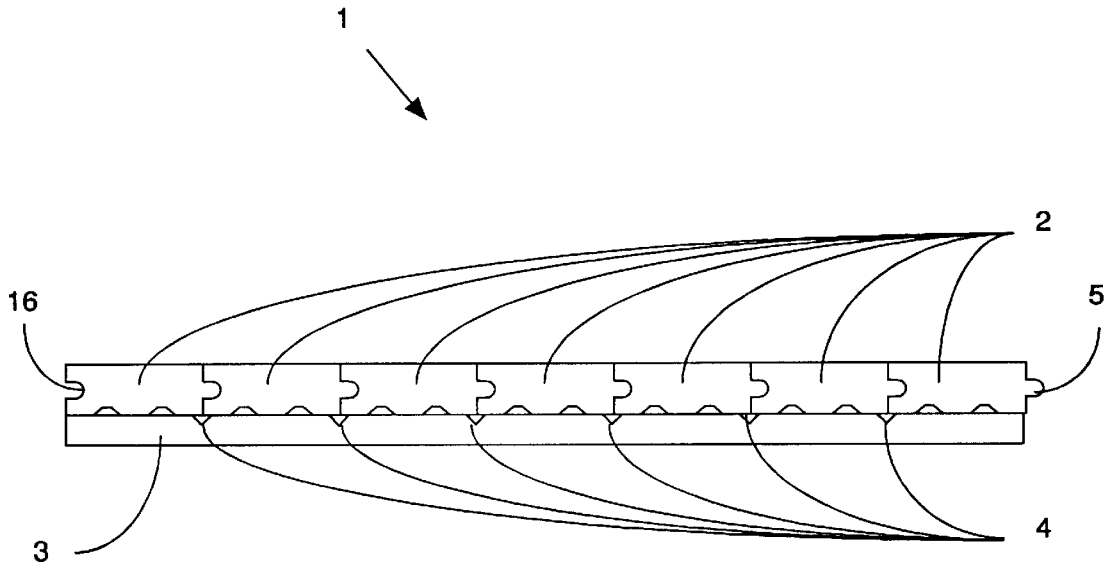
FIG. 2 is a side edge view of a preferred embodiment of a hardwood floor panel which shows the hardwood strips attached to a substrate.

In FIG. 2, an end view of the floor panel 1, shown in FIG. 1, is illustrated. The substrate 3 provides support for the hardwood strips 2 which are adhered to the surface of the substrate 3. As can be seen in this figure, each hardwood strip 2 has a groove 16 and a tongue 5. The tongue 5 on each hardwood strip 2 is sized to fit within the groove 16 of the adjacent hardwood strip 2.

Another advantage provided by the thicker floor structure that results from the substrate 3 and the hardwood strips 2 is that the underlying floor does not have to be as carefully leveled prior to installation. This greatly reduces installation time and reduces the potential for maintenance calls which might have occurred with the installation of a conventional hardwood floor.

Figure 3A:
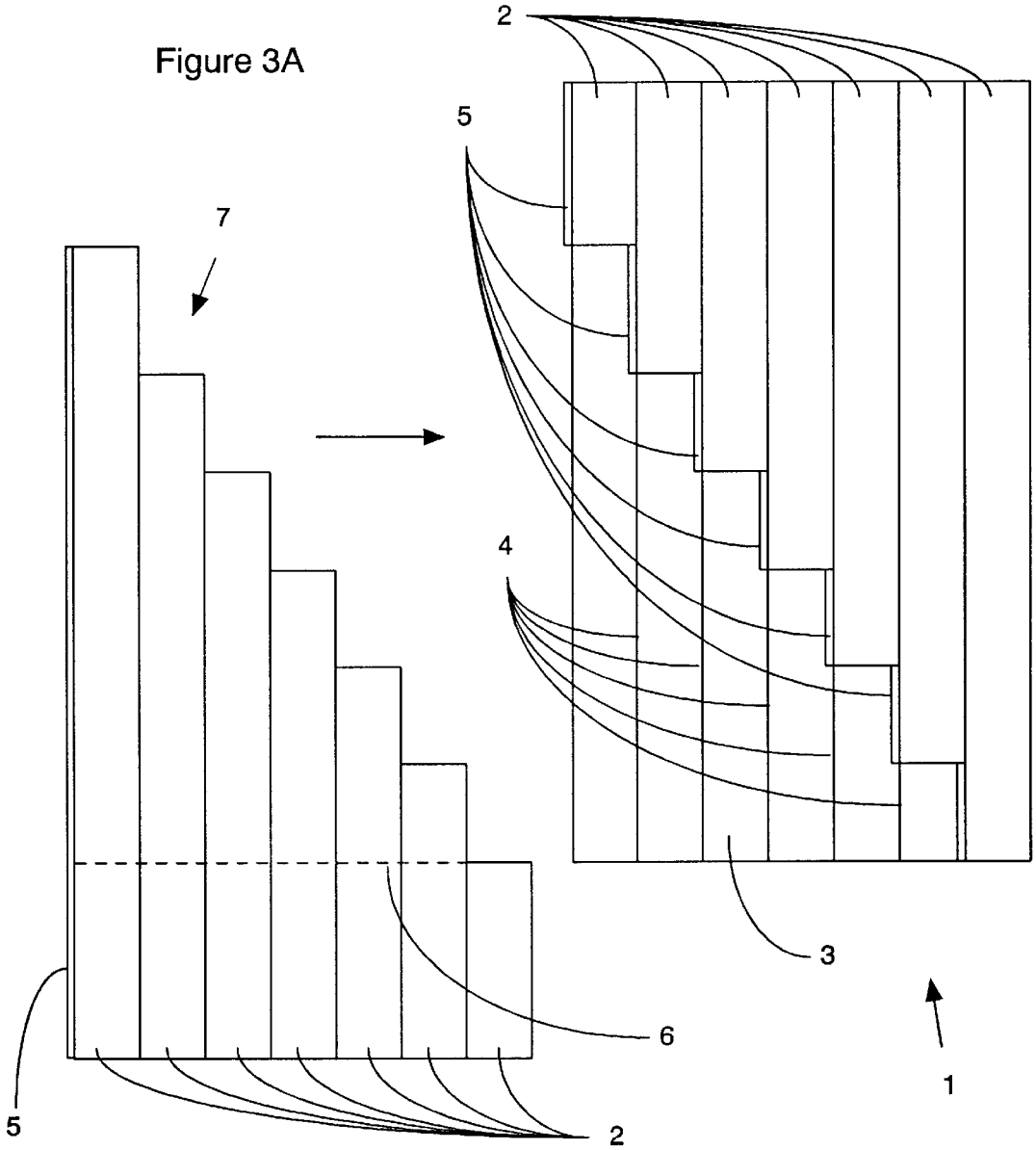
FIG. 3A is a top plan view of a preferred embodiment of a hardwood floor panel just prior to being joined to an adjacent hardwood floor panel.

FIG. 3A and illustrates a floor panel 1 and a second floor panel 7 that are designed to interlock with one another. For ease of illustration, the distal and proximal ends of floor panels 1 and 7, respectively, are shown having squared ends. In practice, only floor panels which were intended to abut a wall would be straight. In normal situation, there would be several floor panels that extend across a room, with all but the two floor panels that abut the wall having irregular hands. By having each of hardwood strips 2 end at a different location, the floor panels will not have a single seam line that extends across the width of the floor. As a result, the installed floor will not appear to be fabricated from floor panels, but will instead they appear to be fabricated from individual hardwood strips 2.

The grooves 16 on hardwood strips 2 on the second floor panel 7 can be joined with the tongues 5 on the hardwood strips 2 on floor panel 1. In addition, adhesive can be applied to the upper surface of substrate 3 on floor panel 1 to further secure the hardwood strips 2 on second floor panel 7.

Figure 3B:
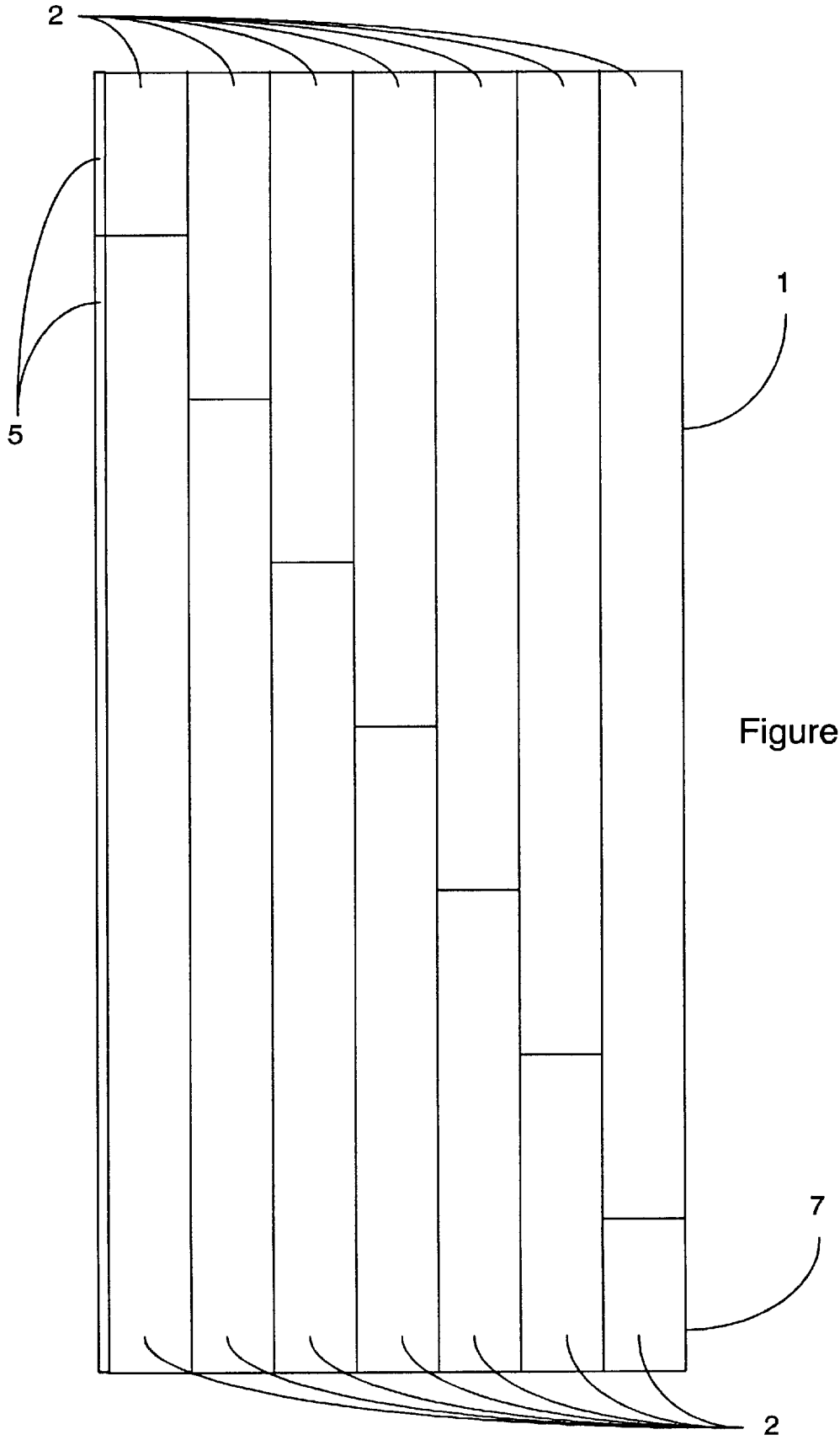
FIG. 3B is a top plan view of a preferred embodiment of a hardwood floor panel just after being joined to an adjacent hardwood floor panel.

In FIG. 3B shows the floor panel I and the floor panel 2 of FIG. 3A after they have been secured together. As can be seen from this figure, the ends of the individual hardwood strips 2 each end at the different location. This provides a significant esthetic benefit by eliminating the straight seam line that a rectangular panel would create. By staggering the ends of the hardwood strips 2, the resulting floor has the appearance of a custom installation in which each hardwood strip 2 was individually laid. Optionally, the substrate of the first floor panel 1, when slid under the hardwood strips 2 of the second floor panel 1, can be secured together via any suitable means, such as adhesive. Likewise, when the tongues and grooves of two adjoining floor panels 1 are mated, they can also be secured via adhesive.

Figure 3C:
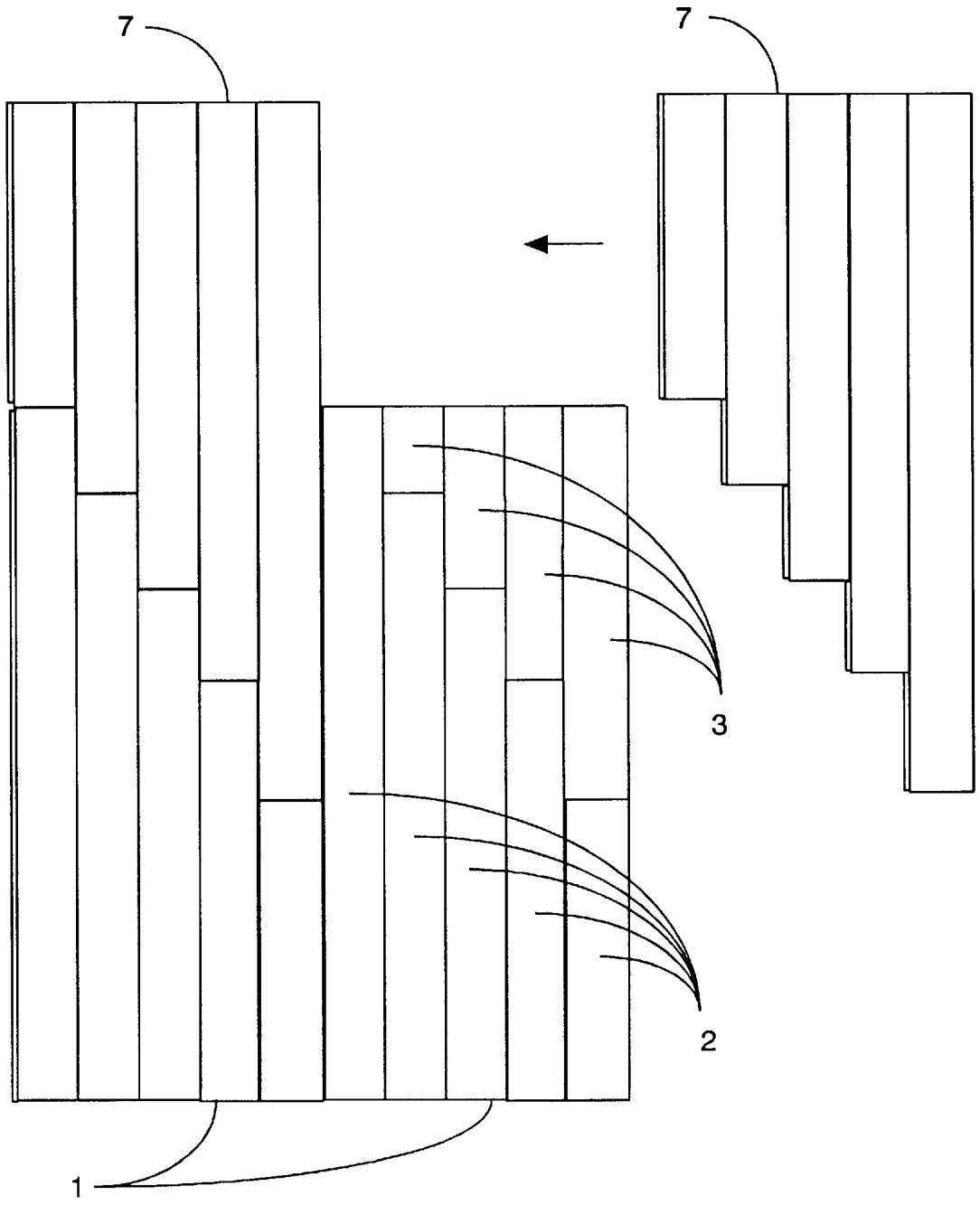
FIG. 3C is a top plan view of a preferred embodiment of a hardwood floor panel just prior to being joined to several adjacent hardwood floor panels.

FIG. 3C illustrates multiple floor panels 1, 7 installed one against another to complete an entire floor area. A principal advantage of the floor panel system disclosed herein is that the use of floor panels 1, 7 allows large areas of the floor to be installed in a short period of time since the installer is laying multiple hardwood strips 2 at the same time. In addition, the installer does not need much skill to install floor panels 1, 7 since they will self align due to the stepped pattern created by the varying lengths of the hardwood strips 2. Also, by prefabricating the floor panels 1, 7, the seam between each adjacent hardwood strip 2 on floor panels 1, 7 will be minimized due to the advantage provided by manufacture in factory setting rather than individual installation of the hardwood strips 2 at the work site. Due to the self alignment and tighter fit of adjacent hardwood strips 2, even an unskilled homeowner can install hardwood floors with results that appear to be the work of a skilled craftsman.

For all of the embodiments disclosed herein, the distal and proximal ends are shown as straight lines because the ends of the floor panels 1, 7 would practice abut the wall of the room in which the floor panels 1, 7 were being installed in. Those skilled in the art will recognize that since rooms vary in size longitudinally, the ends of one of the floor panels 1, 7 would have to be trimmed to allow the floor panels 1, 72 fit between the opposing walls of the room. Likewise, to allow the floor panels 1, 7 to fit laterally between the other two walls, the width of floor panels 1, 7 can be adjusted on a gross level by breaking the floor panels 1, 7 along a selected score line 4. A finer adjustment in width can be made by trimming and individual hardwood strip 2.

Figure 4A:
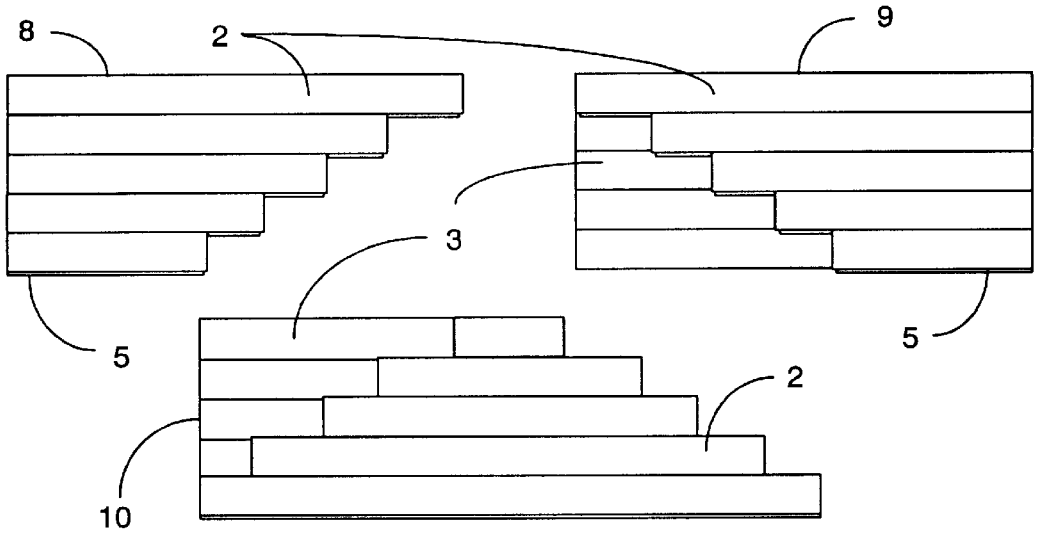
FIG. 4A is a top plan view of an alternative preferred embodiment which illustrates multiple floor panel segments prior to being joined together.

FIG. 4A illustrates the use of floor panels 8, 9, 10 to install a hardwood floor over an extended length. In this embodiment, only three floor panels 8, 9, 10 are shown for ease of illustration. However, there is no limit on the number of floor panels that could be installed between two floor panels 8, 9 on the opposite ends of the floor. Also shown in this figure is the use of substrates 3 on floor panels 9, 10 to provide support for and needs to attach to the adjacent floor panels 10, 8, respectively.

Figure 4B:
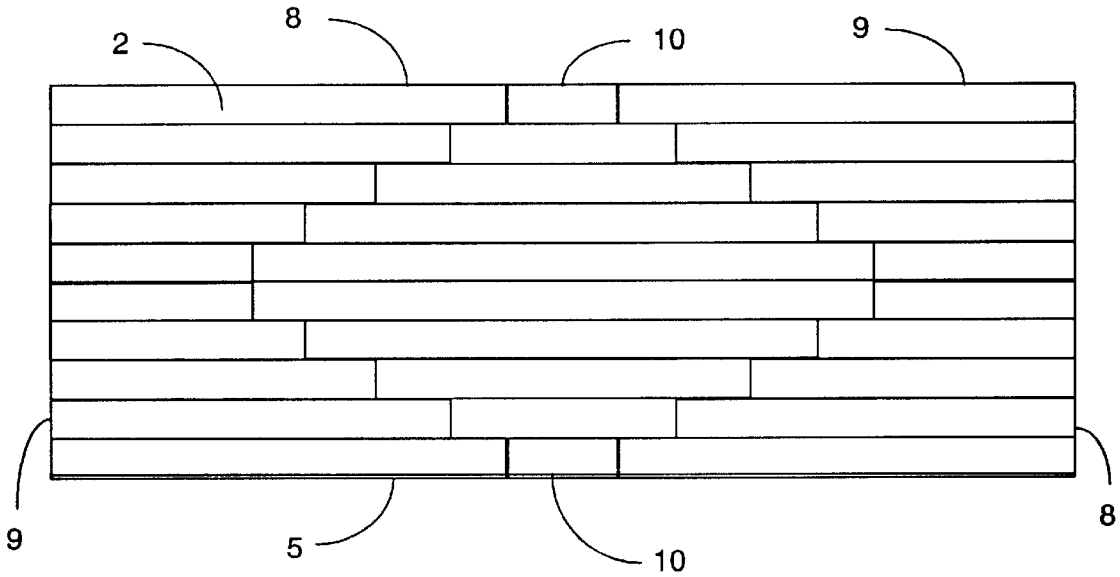
FIG. 4B is a top plan view of an alternative preferred embodiment which illustrates multiple floor panel segments after being joined together to form a specific predetermined pattern.

In FIG. 4B, the use of the floor panels to form patterns on floor is illustrated. By altering the respective lengths of floor panels 8, 9, 10, the pattern formed by the installed floor panels 8, 9, 10 will vary. In addition, by installing alternating sequences of floor panels 8, 9, 10 as is shown in this figure, specific decorative shapes (such as the diamond shape shown in this figure) can be formed. Furthermore, different woods be used to form specific patterns in the floor. For example, the diamond shape formed by the adjoining floor panels 10 can be emphasized by using woods having different colors on grain patterns. If the light wood, such as birch was used for floor panels 8, 9 and a dark wood such as black walnut was used for floor panels 10, then the diamond shape would be much more visible. While a diamond shape was used for ease of illustration, those skilled in the art will recognize that the variety and number of patterns available is only limited by the imagination of the designer.

While FIGS. 4A–B illustrate the use of the floor panels to form patterns and designs. FIG. 4B shows a simple diamond pattern. However, those skilled in the art will recognize that more intricate designs, including product and company logos, can also be formed in the floor panels using this technique. For ease of discussion, the formation of designs by using floor panels having specific patterns, whether they be for purely aesthetic reasons, or for commercial purposes such as the display of corporate logos, etc. will be referred to herein as indicia.

Figure 5:
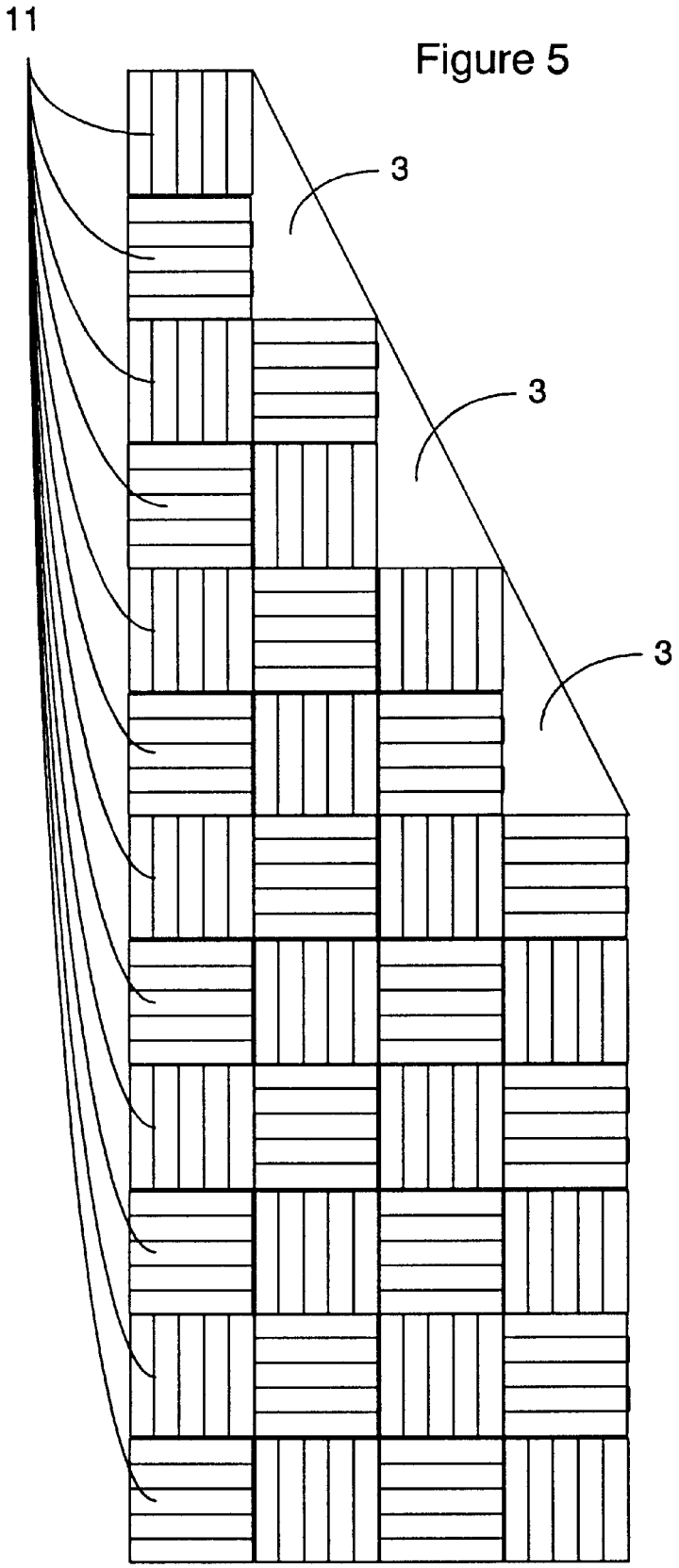
FIG. 5 is a top plan view of another alternative embodiment in which parquet flooring is installed via the prefabricated hardwood floor panels.

FIG. 5 is an alternative preferred embodiment which illustrates the use of interlocking floor panels to install parquet flooring. In this figure, hardwood parquet squares 11 are secured to the substrate 3. The floor panel would be installed with other floor panels in the same manner as was done for the previous embodiments. In addition, the various embodiments can be combined to form more complex patterns. For example, parquet squares 11 could be used in conjunction with floor panel 10, discussed earlier, to make the diamond pattern of FIG. 4B more interesting. Likewise, different types of wood be used to form borders around the edge of a room.

Figure 6A:
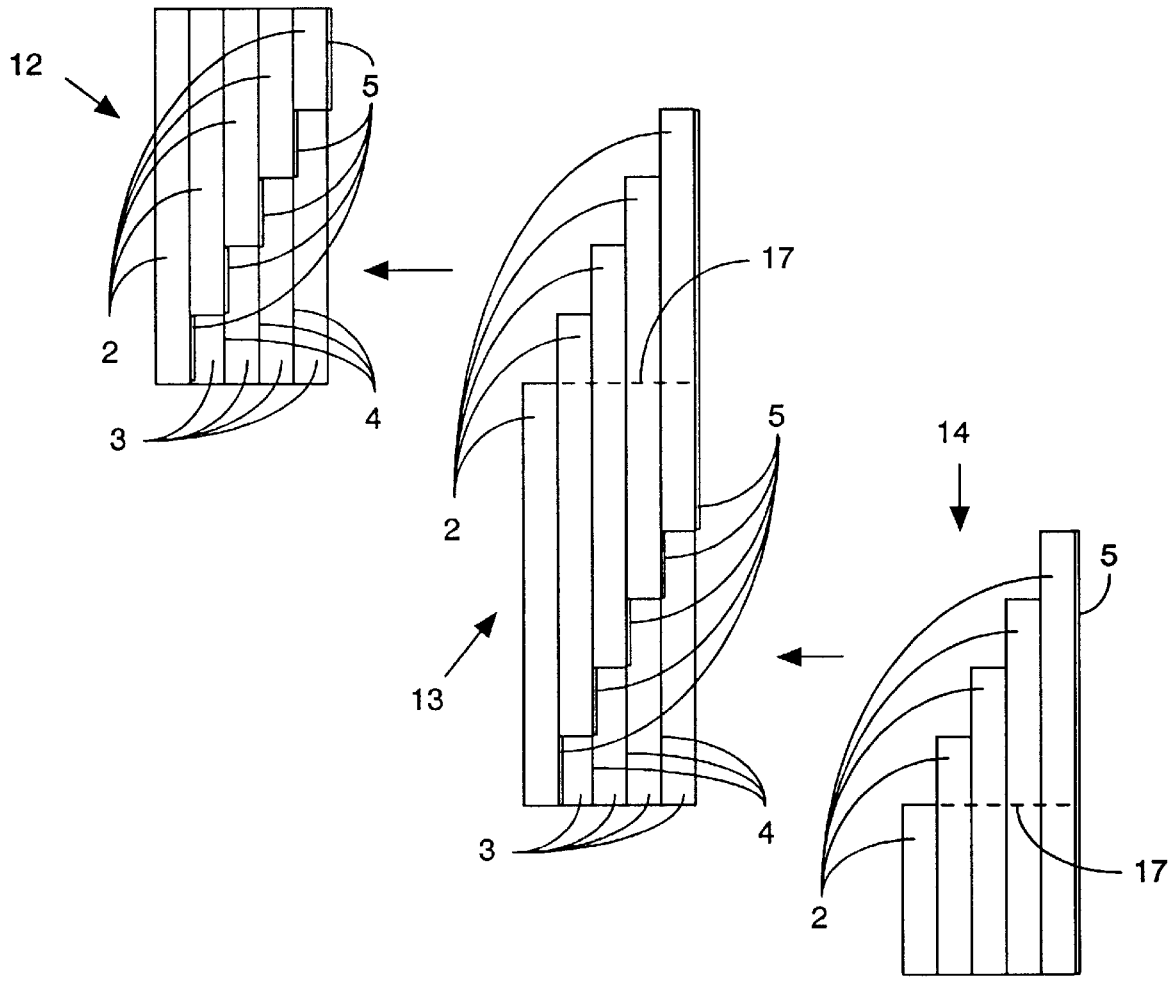
FIG. 6A is a top plan view of an alternative preferred embodiment which illustrates multiple floor panel segments prior to being joined together.

FIG. 6A illustrates the use of multiple floor panels 12, 13, 14 to form an extended hardwood floor. For ease discussion, only one intermediate floor panel 13 is shown. However, those skilled in the art will recognize that any number of intermediate floor panels 13 can be used to install a hardwood floor of any size. Once the first floor panel 12 is installed, intermediate floor panels 13 can be rapidly installed one after another. The final floor panel 14 can then be installed to complete that section of the floor. Substrate 3 a shown forming a support for the hardwood strips 2. As each successive floor panel 13, 14 is attached, they are secured both to the substrate 3 of the adjacent panel as well as to the hardwood strips 2 of the adjacent panel. Dashed lines 17 on floor panels 13, 14 illustrate the location of the end of substrate 3 in the preferred embodiment.

By installing the first floor panel 12 in a corner, the intermediate floor panels 13 can be slid into place as indicated by the allows. When the last floor panel 14 is installed, it is cut to fit the corner it will occupy and slid into place in the same manner as the previous floor panels.

Figure 6B:
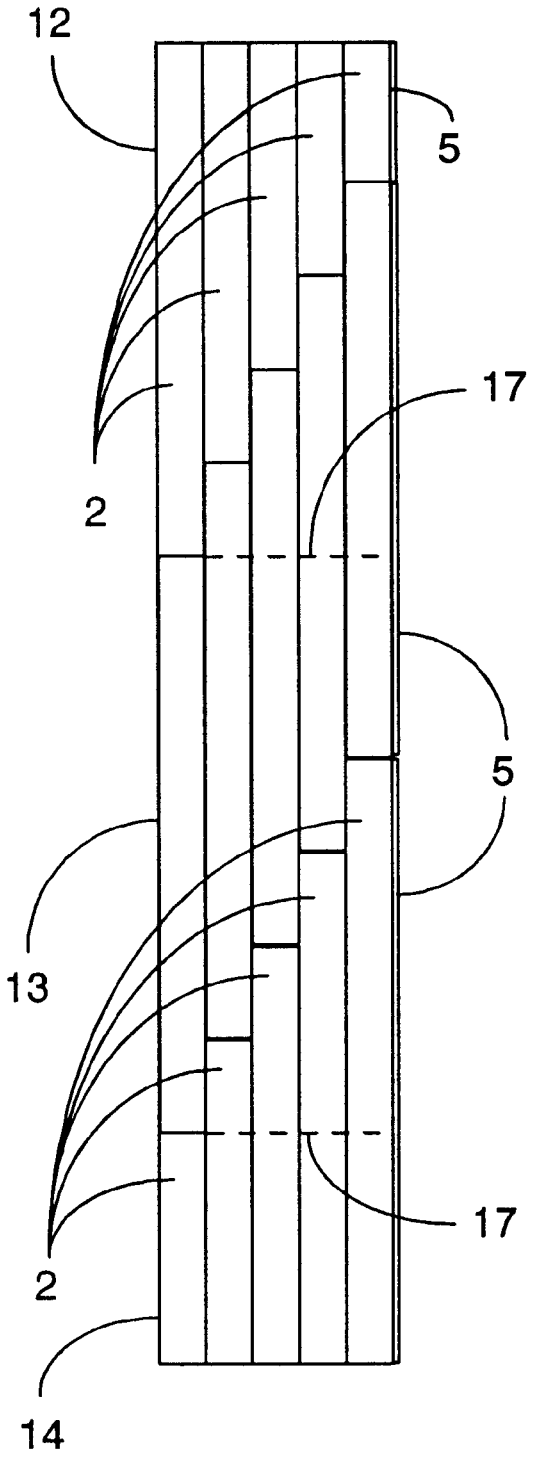
FIG. 6B is a top plan view of an alternative preferred embodiment which illustrates multiple floor panel segments after being joined together to form a specific predetermined pattern.

In FIG. 6B, floor panels 12, 13, 14 are shown in the mated position. As was the case in the previous embodiments, by positioning the hardwood strips 2 such that they end in different locations, no seam is visible to indicate where one floor panel ends in the other begins.

Figure 7A:
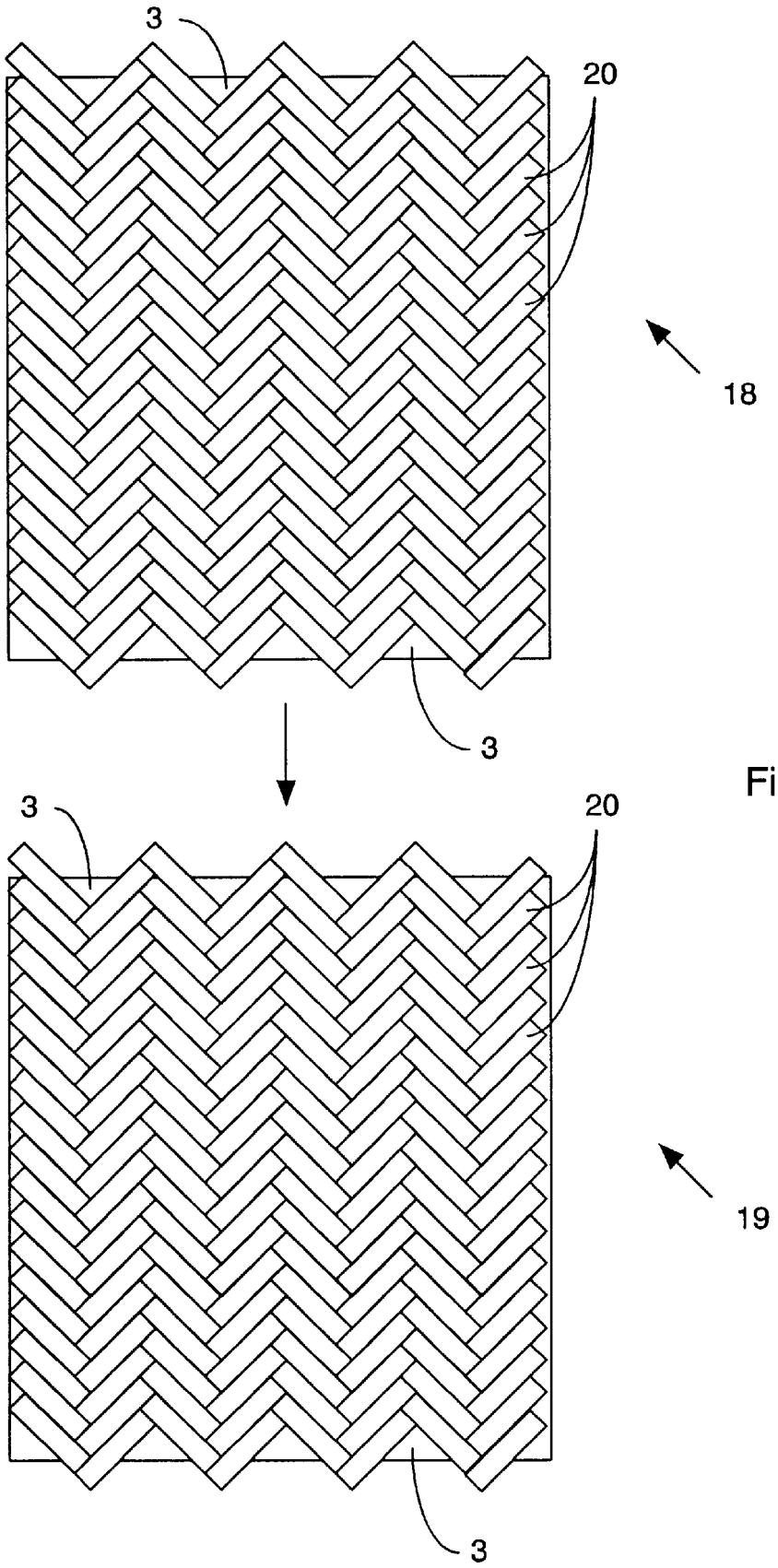
FIG. 7A is a top plan view of an alternative embodiment that uses hardwood strips that are arranged and herringbone pattern on a floor panel. Two disconnected floor panels are shown prior to being mated.

In FIG. 7A, an alternative preferred embodiment shown. In this embodiment, small hardwood strips 20 are arranged in a herringbone pattern on a substrate 3. This figure shows two floor panels 18, 19, which are about to be mated. When installing hardwood flooring, such as the herringbone pattern of this figure, the installer can save substantial amounts of time by installing floor panels 18, 19 would hold large numbers of individual small hardwood strips 20. Prior to this, and installer using prior art methods would have to install each small hardwood strip 20 individually. As a result of using the floor panels 18, 19, the installer is able to install large areas of herringbone flooring in a short amount of time. In addition, since the herringbone pattern was installed on substrate 3 at the factory, the fit and precision of the installation will be up to minimum factory standards, thereby guarantee the minimum level of quality.

Figure 7B:
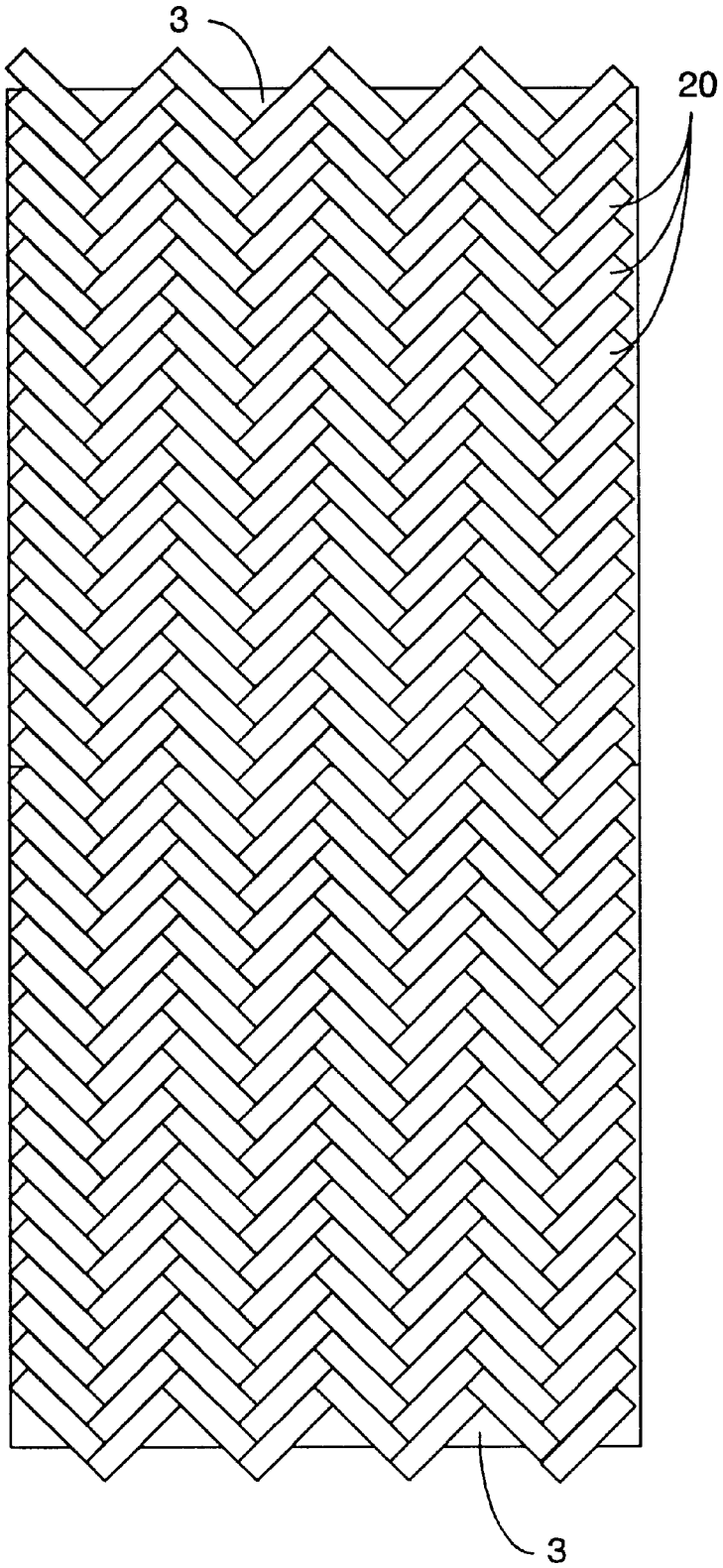
FIG. 7B is a top plan view of the embodiment of FIG. 7A in which the two floor panels have been mated.

FIG. 7B illustrates the embodiment of FIG. 7A with the two floor panels 18, 19 mated together. As a result of this process, a single installer can install large areas of herringbone flooring in a minimum amount of time, resulting in reduced labor cost.

As can be seen from the foregoing embodiments, the floor panel provided herein can be implemented by securing a plurality of hardwood segments to a substrate such that the hardwood segments are secured to one another and at the same time secured to the substrate. This provides substantial strength and stability since the hardwood segments, by being secured to the underlying substrate and to the adjacent hardwood segments, are secured in two planes. Further, the panels are secured together in a similar manner. In particular, the hardwood segments on one floor panel are secured to adjacent substrates and the hardwood segments attached to the adjacent floor panel. The resulting floor has improved stability because each component of each floor panel in this system acts to secure the components on its floor panel and on adjacent floor panels.

A further advantage of the system is that the hardwood segments used to form the flooring surface can be straight strips of conventional hardwood flooring, or they can take any other suitable form, such as parquet squares, herringbone strips, or irregular shapes such as indicia.

While the invention has been described with respect to a preferred embodiment thereof, it will be understood by those skilled in the art that various changes in detail may be made therein without departing from the spirit, scope, and teaching of the invention. For example, the material used to fabricate the substrate may be anything suitable for supporting the flooring material. The flooring material may be wood, synthetics, tile, marble, etc.. The size and shape of the substrate may vary based on its intended use. The type of adhesive, if any, used to secure the hardwood strips to the substrate can vary. Accordingly, the invention herein disclosed is to be limited only as specified in the following claims.

I claim:

1. A hardwood flooring system, comprising:

a plurality of hardwood panels, each hardwood panel further comprising:

a substrate;

a plurality of hardwood segments, each hardwood segment secured to the substrate, and further secured to adjacent hardwood segments such that the hardwood segments form an extended hardwood surface; and the hardwood segments on each hardwood panel are arranged on their substrate such that the periphery of the hardwood segments on each hardwood panel forms an irregular periphery pattern, at least a portion of the hardwood segments extending substantially past the end of the substrate and at least a portion of the substrate extending past a portion of the hardwood segments;

the irregular periphery pattern on each hardwood panel is matched to the irregular pattern on the adjacent hardwood panel such that when the panels are joined together, the hardwood segments on the first panel interlock with the hardwood segments on the second panels and the seams between the hardwood segments appear to be in random locations such that a floor formed by the hardwood panels will appear to be a custom hardwood floor constructed from individual hardwood segments and not appear to be a modular floor constructed from rectangular flooring panels;

the portion of the hardwood segments that extend substantially past the end of the substrate, when the hardwood panel is secured to an adjacent hardwood panel, overlay a substantial portion of the adjacent hardwood panel's substrate such that a substantial portion of the hardwood strips are securable to the substrate on the adjacent hardwood panel, and the portion of the substrate that extends substantially past the end of the hardwood segments, when the hardwood panel is secured to an adjacent hardwood panel, underlays a substantial portion of the adjacent hardwood panel's hardwood strips such that a substantial portion of the hardwood strips are securable to the substrate on the adjacent hardwood panel; and the hardwood panel, when attached to an adjacent hardwood panel, have a substantial portion of the hardwood strips secured to the substrate of the adjacent hardwood panel, and have a substantial portion of the substrate secured to the hardwood strips of the adjacent hardwood panel;

whereby hardwood flooring is installed by hardwood panels having multiple hardwood segments with irregular seam lines that give the appearance of a custom hardwood floor, and the irregular pattern provides a substantial overlap to secure the hardwood strips of one hardwood panel to the substrate of the adjacent hardwood panel.

2. A system, as in claim 1, wherein:

at least a portion of the edges of the hardwood segments further comprise a tongue; and at least a portion of the edges of the hardwood segments further comprise a groove;

whereby the tongue on the edge of a hardwood segment interlocks with the groove on the edge of an adjoining hardwood segment.

3. A system, as in claim 2, further comprising:

score lines at preselected locations on the substrate, the score lines aligned with the hardwood segments such that when the hardwood panel is sufficiently bent, it will break along the score lines such that predetermined hardwood segments will be detached from the hardwood panel along with the underlying substrate;

whereby breaking the hardwood panel along the score line reduces the size of the hardwood panel.

4. A system, as in claim 1, further comprising:

score lines at preselected locations on the substrate, the score lines aligned with the hardwood segments such that when the hardwood panel is sufficiently bent, it will break along the score lines such that predetermined hardwood segments will be detached from the hardwood panel along with the underlying substrate;

whereby breaking the hardwood panel along the score line reduces the size of the hardwood panel.

5. A system, as in claim 1, wherein the substrate of the hardwood panel extends beyond at least one of the hardwood segments such that when the hardwood panel is attached to an adjacent hardwood panel, the substrate on the hardwood panel is under at least one of the hardwood segments of the adjacent hardwood panel.

6. A system, as in claim 5, further comprising the substrate further comprises apertures for securing the substrate to an underlying floor via nails.

7. A system, as in claim 5, wherein the substrate on the hardwood panel, when attached to the adjacent hardwood panel is secured to the hardwood segment on the adjacent hardwood panel.

8. A system, as in claim 7, wherein the hardwood segments have tongue and groove portions and are joined to one another via the tongue and groove portions.

9. A system, as in claim 8, wherein:

the tongues on the hardwood panel, when the hardwood panel is attached to the adjacent hardwood panel, mate with grooves on the adjacent hardwood panel;

whereby the tongues and grooves secure the hardwood panels together.

10. A system, as in claim 5, wherein the hardwood segments are arranged to form indicia.

11. A method of installing hardwood floors with hardwood floor panels that appear to be hardwood floors installed from individual hardwood segments, including the steps of:

installing a plurality of hardwood panels, each hardwood panel having a substrate and a plurality of hardwood segments, each hardwood segment secured to the substrate, and further secured to adjacent hardwood segments such that the hardwood segments form an extended hardwood surface;

arranging the hardwood segments on the hardwood panels on their substrates such that the periphery of the hardwood segments forms an irregular pattern, the irregular pattern on a selected hardwood panel is matched to the irregular pattern on an adjacent hardwood panel such that when the hardwood panels are joined together, the seams created by adjacent hardwood segments are arranged in random order to disguise the existence of the hardwood panels by eliminating continuous seams between hardwood panels, and extending at least a portion of the hardwood segments substantially past the end of the substrate and extending at least a portion of the substrate substantially under a portion of the hardwood segments;

extending the substrate beyond at least one of the hardwood segments on a hardwood panel such that when the hardwood panel is attached to an adjacent hardwood panel, the substrate on the hardwood panel is under at least one of the hardwood segments of the adjacent hardwood panel;

extending a portion of the hardwood segments substantially past the end of the substrate, when the hardwood panel is secured to an adjacent hardwood panel and overlaying a substantial portion of the adjacent hardwood panel's substrate such that a substantial portion of the hardwood strips are securable to the substrate on the adjacent hardwood panel, and extending a substantial portion of the substrate past the end of the hardwood segments such that when the hardwood panel is secured to an adjacent hardwood panel, it underlays a substantial portion of the adjacent hardwood panel's hardwood strips and a substantial portion of the hardwood strips are securable to the substrate on the adjacent hardwood panel; and the hardwood panel, when attached to an adjacent hardwood panel, have a substantial portion of the hardwood strips secured to the substrate of the adjacent hardwood panel, and have a substantial portion of the substrate secured to the hardwood strips of the adjacent hardwood panel;

whereby multiple hardwood segments are simultaneously installed when the hardwood flooring panel is installed and the irregular pattern formed by the hardwood segments creates the appearance of a custom installation by preventing extended seam lines, and the irregular pattern provides a substantial overlap to secure the hardwood strips of one hardwood panel to the substrate of the adjacent hardwood panel.

12. A method, as in claim 11, including the additional steps of:

securing the substrate on the hardwood panel that is under the hardwood on the adjacent hardwood panel to the hardwood segment on the adjacent hardwood panel;

forming tongue and groove portions on the hardwood segments and joining the hardwood segments to one another via the tongue and groove portions;

attaching the first hardwood panel to the second hardwood panel by mating the tongues on the first hardwood panel to the grooves on the second hardwood panel;

whereby the tongues and grooves secure the hardwood segments together and the first and second hardwood panels together.

13. A method, as in claim 12, including the additional step of: locating score lines at preselected locations on the substrate, the score lines aligned with the hardwood segments such that when the hardwood panel is sufficiently bent, it will break along the score lines such that predetermined hardwood segments will be detached from the hardwood panel along with the underlying substrate;

whereby breaking the hardwood panel along the score line reduces the size of the hardwood panel.

14. A method, as in claim 13, including the additional step using hardwood strips for the hardwood segments.

15. A method, as in claim 13, including the additional step of forming indicia with the hardwood segments.

* * * * *